US005080148A

United States Patent [19]

Florida

[11] Patent Number: 5,080,148

[45] Date of Patent: Jan. 14, 1992

[54] VOLUME ADJUSTMENT DEVICE FOR A FILLER

[75] Inventor: William F. Florida, Fresno, Calif.

[73] Assignee: FMC Corporation, Chicago, Ill.

[21] Appl. No.: 611,230

[22] Filed: Nov. 9, 1990

[51] Int. Cl.[5] ..... B65B 3/12

[52] U.S. Cl. ..... 141/266; 141/258; 141/27; 222/309

[58] Field of Search ..... 222/283, 309, 287; 141/266, 258-261, 27

[56] References Cited

U.S. PATENT DOCUMENTS

| | | | |
|---|---|---|---|
| 3,799,406 | 3/1974 | St. John et al. | 222/309 |
| 4,091,969 | 5/1978 | Easter et al. | 222/309 |
| 4,300,603 | 11/1981 | Laub, III | 141/258 |
| 4,437,498 | 3/1984 | Pankratz et al. | 141/258 X |
| 4,648,533 | 3/1987 | Rasmussen | 222/309 |
| 4,871,001 | 10/1989 | Nobuta et al. | 141/258 X |

FOREIGN PATENT DOCUMENTS

| | | | |
|---|---|---|---|
| 2702539 | 8/1977 | Fed. Rep. of Germany | 222/309 |

*Primary Examiner*—Ernest G. Cusick

*Attorney, Agent, or Firm*—A. J. Moore; R. C. Kamp; R. B. Megley

[57] ABSTRACT

A volume adjustment device for a filler is disclosed which simultaneously permits rough adjustment of a plurality of pistons within product cylinder and also permits fine volumetric tuning of each piston for precisely measuring predetermined volume of flowable product being discharged into containers or the like thus providing more accurate fill volumes and also minimizing fill volume differences between stations.

2 Claims, 3 Drawing Sheets

VOLUME ADJUSTMENT DEVICE FOR A FILLER

FIELD OF THE INVENTION

The present invention relates to method and apparatus for making one fill volume adjustment to a multiple row product filler, and at the same time providing for more accurately controlling fill volume for substantially eliminating fill volume differences between the stations without the aid of tools thus easily and quickly disassembling and assembling the fill volume adjustment device and the filler for cleaning. The adjustment device also uses fewer parts and provides for simple adjustment to minimize set up time, and further provides soft stops for quiet shockless operation.

CROSS REFERENCE TO RELATED APPLICATIONS

The present invention is related to the assignee's following application filed on even date herewith and identified as application Ser. No. 07/612,026 filed on Nov. 9. 1990 for FILLER SPOOL VALVE.

SUMMARY OF THE INVENTION

A volume adjusting device for a filler is disclosed which directs a flowable product through a plurality of ports in an elongated valve into a plurality of product cylinders. Separate pneumatic actuators are connected to piston rods of the product cylinders by removable links for simplifying cleaning of the product cylinders, and separate fine adjustment mechanisms are operatively connected to each piston rod of the product cylinder for independently making minute changes for assuring that each product receiving cylinder receives the precisely measured, desired volume of flowable product.

DESCRIPTION OF THE PREFERRED EMBODIMENT

The volume adjustment device 10 (FIGS. 1-4) of the present invention may be used with many types of fillers 11 adapted to handle flowable products.

Figure 2:
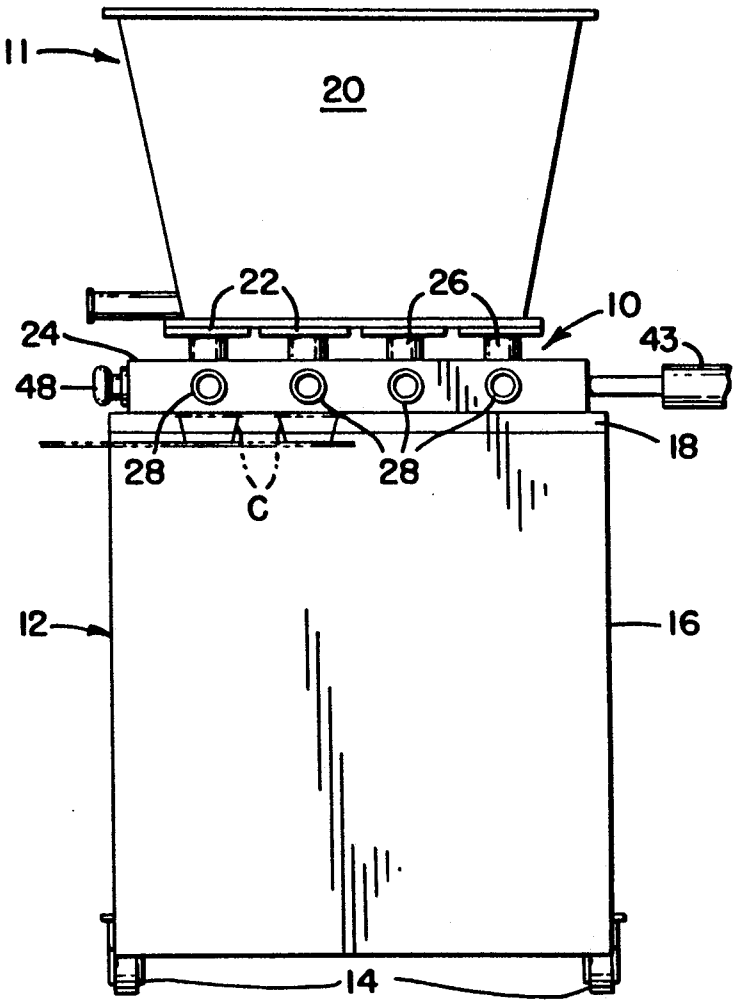
FIG. 2 is an end view of the filler system of FIG. 1 illustrating the outlets of four volume adjustment devices.
Figure 1:
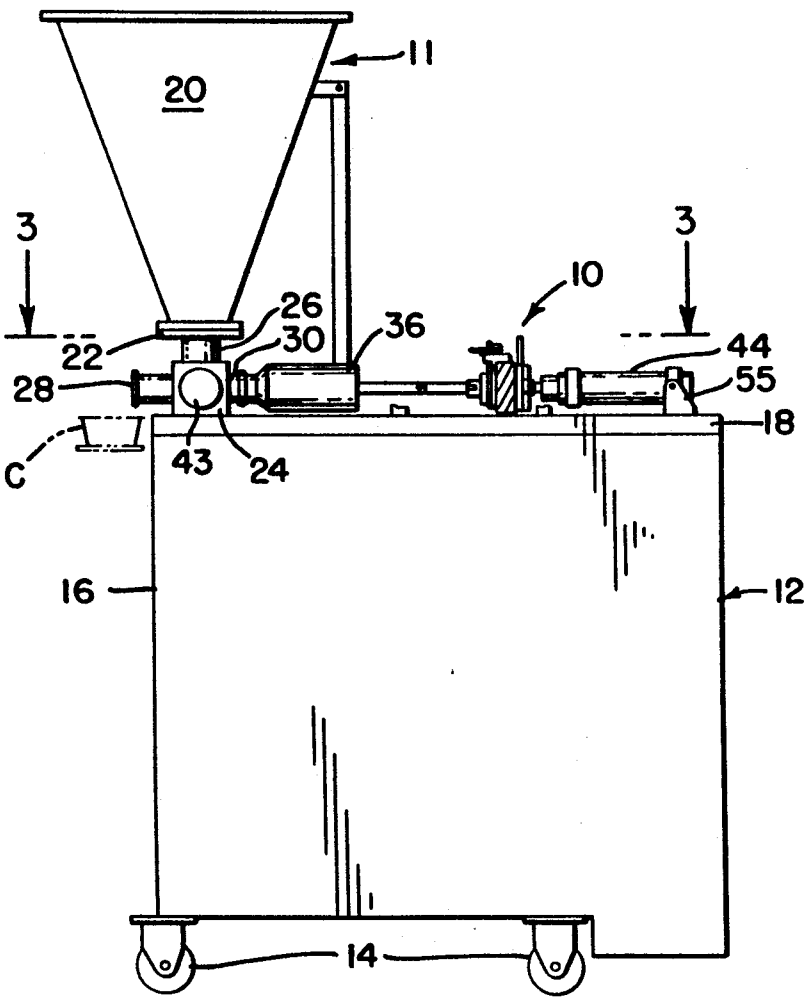
FIG. 1 is a side view of a multiple filler system illustrating one volume adjustment device thereon.

FIGS. 1 and 2 illustrate a movable cart 12 supported on wheels 14 and having a frame 16 and a top plate 18. A hopper 20 containing a flowable product (not shown) is secured to one or more flanged inlet ports 22 of a valve housing 24 as by bolting, with four inlet ports 22 being illustrated in FIG. 2. The hopper 20 and valve 24 are also supported on the top plate 18 by bolts.

Figure 3:
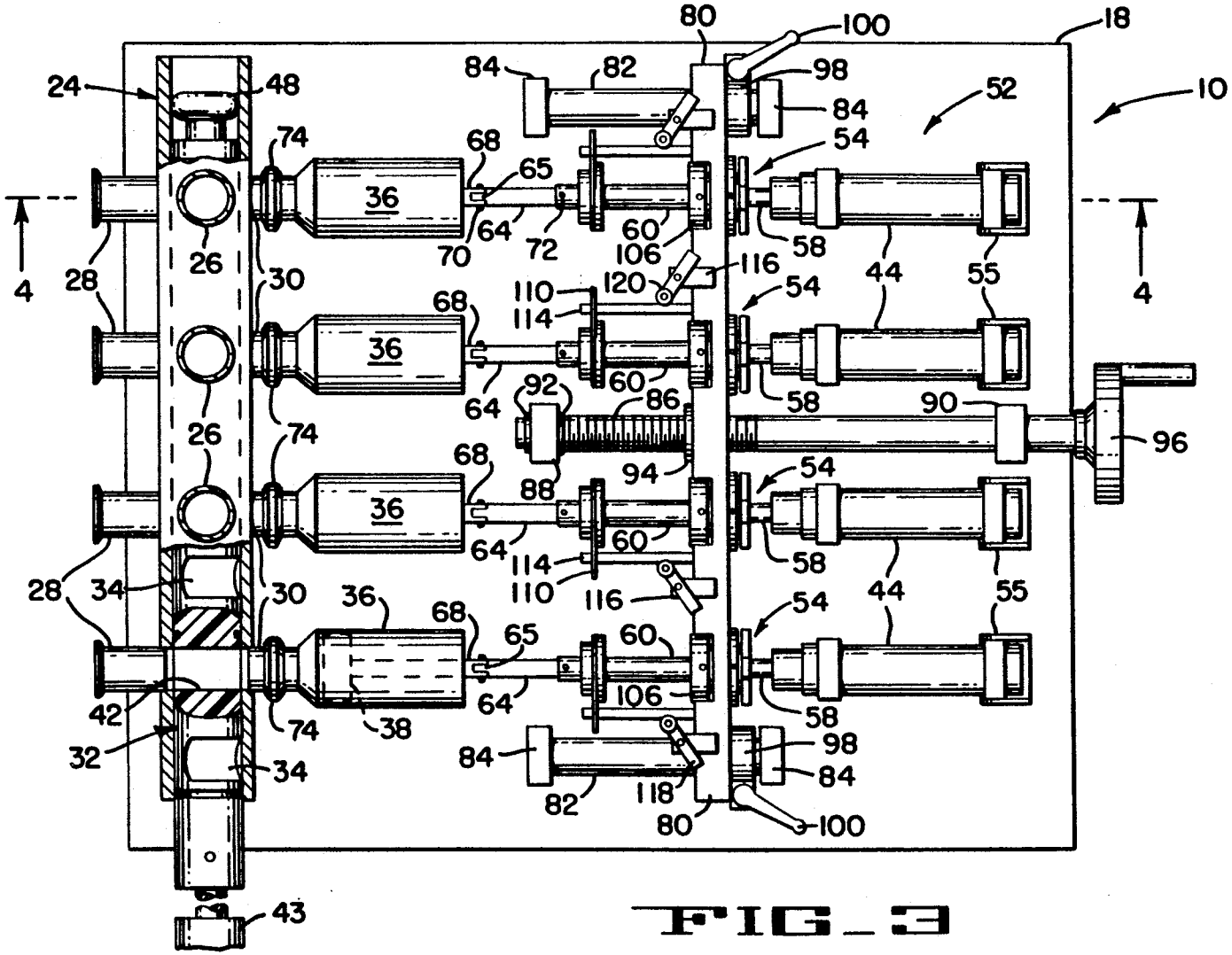
FIG. 3 is a section taken along lines 3—3 of FIG. 1 illustrating four filler systems of the present invention, certain parts being shown in section.

As best shown in FIGS. 2 and 3, the valve housing 24 is elongated and, as illustrated, includes four flanged inlet tubes 26 bolted to four flanged discharge openings of the hopper 20. Similarly, four flanged outlet tubes 28, and four pairs of flanged inlet-outlet tubes 30 are aligned with each other.

The valve housing 24 receives an elongated valve core 32 having a plurality of equally spaced curved slots 34 (FIG. 4), only one being shown, for directing the flowable product from the hopper 20 into each of a plurality of product cylinders 36, each of which has a piston 38 therein which is sealed to the cylinder by O-rings 40. The product cylinders 36 each receive a precise volume of flowable product therein thereby assuring that precise amounts of flowable product are discharged into containers C (FIGS. 1 and 2), such as, but not limited to; trays, cans and similar containers.

The valve core 32 is preferably made from plastic, is non-rotatable, and also includes a plurality of equally spaced linear passages 42 (only one being shown in FIG. 3) which are aligned with associated ones of the product cylinders 36 when the valve core 32 is moved axially of the valve housing by reciprocating power means illustrated as pneumatic cylinders 44, hereinafter called air cylinders. When the linear passages 42 (only one being shown in FIG. 3) are aligned with associated product cylinders 36, the piston 38 in each product loaded cylinder is moved from the full position shown in solid lines in FIG. 4 to the retracted position shown in phantom lines in FIGS. 3 and 4 thereby discharging the flowable product through the linear passages 42, through the flanged outlet port 28, through a flexible hose and a dispensing valve (not shown) and into containers C or the like illustrated below the outlet tubes in FIGS. 1 and 2.

An important feature of the invention is the provision of a fill volume adjustment apparatus 52 (FIGS. 3 and 4) for simultaneously making preliminary adjustments of the volume of a flowable product in each of the product cylinders 36, and to thereafter provide fine tuning mechanisms 54 for individual product cylinders to minimize volume differences between the several product cylinders 36 without requiring tools for making major or minor adjustments.

The fill volume adjustment apparatus 52 provides for both major and minor adjustments, is of sanitary construction, provides quick disconnect capabilities and fast assembly and disassembly for cleaning, uses fewer parts and simple adjustment to minimize set-up time, and provide soft stops for quiet, shockless operation as will be described hereinafter.

Figure 4:
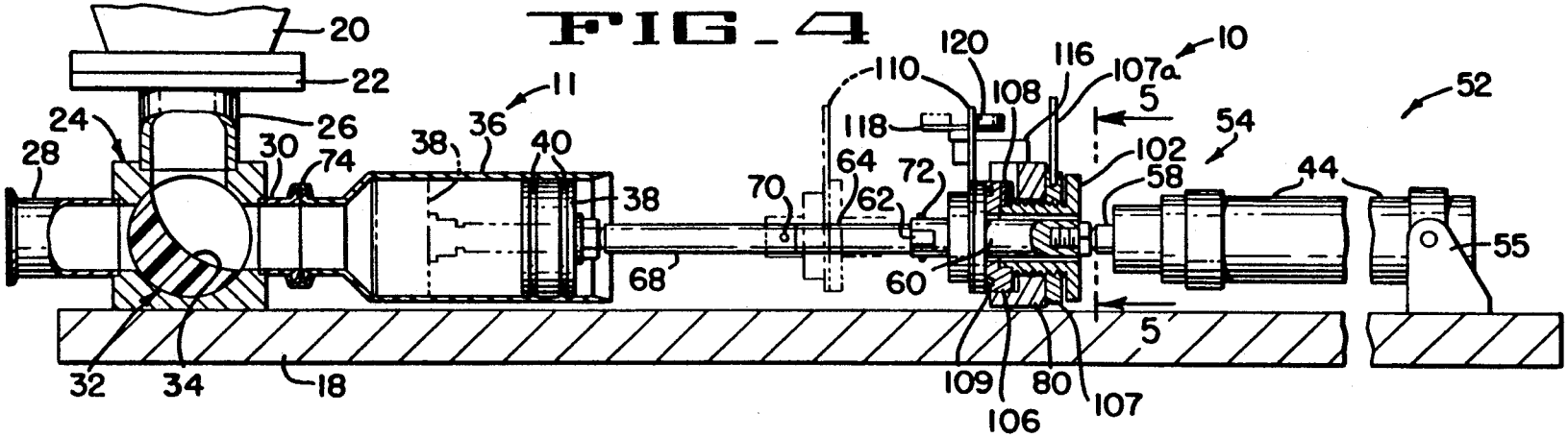
FIG. 4 is an enlarged elevation with parts in section taken along lines 4—4 of FIG. 3.

As illustrated in FIGS. 3 and 4, the fill volume adjustment apparatus 52 includes a plurality of power means in the form of air cylinders 44 which are connected to conventional valves and a source of air under pressure (not shown). Each air cylinder 44 is connected to the top plate 18 by a trunnion 55 and includes a piston rod 58 that is threaded into a stub shaft 60 (FIG. 4) which extends through the associated fine tuning mechanism 54. The other end of the stub shaft 60 is U-shaped to removably receive a tongue 62 (FIG. 4) of an intermediate shaft 64, which intermediate shaft has its other end formed as a tongue 65 (FIG. 3) received in a groove formed in the outer end of a piston rod 68 that is connected to the piston 38 (FIG. 4).

Removable pins 70 and 72 connect the intermediate shaft 64 to the piston rod 68 and to the stub shaft 60 when the filler is in operation. The pins 70,72 are removed when it is desired to clean the product cylinder 36 and its piston 38 after completing the filling of a batch of selected flowable product into the container C (FIGS. 1 and 2). Conventional snap-on clamps 74 (FIGS. 3 and 4) are easily and quickly removed from the flanged inlet-outlet ports 30 thus allowing the components of the cylinders 36 to be quickly and easily cleaned. At the same time, the valve housing 24 and valve core 32 are easily and quickly cleaned after disconnecting the core from the air cylinder 43, and then manually gripping the knob 48 (FIG. 3) and pulling the core free from the housing 24.

Having reference to FIGS. 3–6, a transversely extending slide bar 80 is slidably received on a spaced pair of shafts 82 which are rigidly secured to mounting blocks 84 (FIG. 3) bolted to the top plate 18. A partially threaded shaft 86 is rotatably received in end supports 88 and 90 (FIG. 3) secured to the top plate 18, and is prevented from axial movement by snap rings or the like 92. A non-rotatable, internally threaded collar 94 is rigidly secured to the slide bar 80 and rotatably receives the threaded portion of the shaft 86. A hand crank 96 is rigidly secured to the shaft 86 to allow an operator to simultaneously move all pistons 38 within their cylinders 36 to provide a rough approximation of the desired volume of flowable products to be loaded into the containers C. After the rough approximation of the desired fill volume has been determined, a pair of set collars 98 are clamped on the shafts 82 by threaded levers 100.

The previously mentioned fine tuning mechanisms 54 are provided to easily and precisely control the desired volume of flowable products received in the product cylinder 36 and thus into containers C thereby minimizing errors in the desired amount of product dispensed into the containers.

Figure 6:
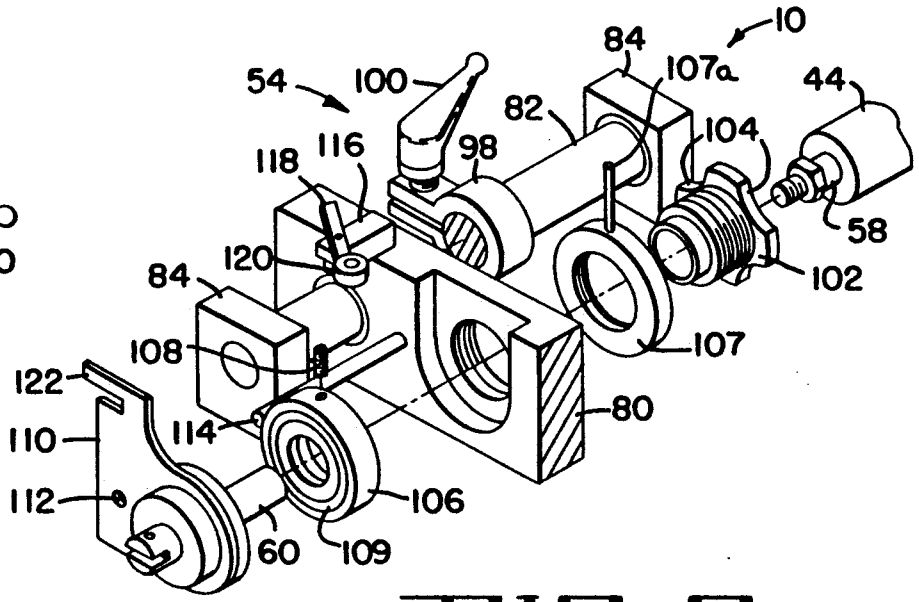
FIG. 6 is an exploded perspective with parts broken away illustrating a fine adjustment mechanism.
Figure 5:
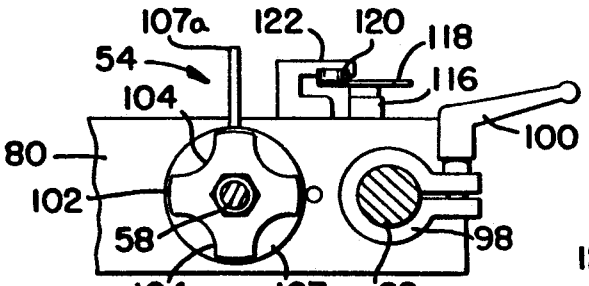
FIG. 5 is a section taken along lines 5—5 of FIG. 4.

The fine tuning mechanisms 54 are best illustrated in FIGS. 4, 5 and 6, with one mechanism being provided for an associated one of the cylinders 36.

Each fine tuning mechanism 54 includes a flange bushing 102 rotatably received on an associated one of the stub shafts 60 and having finger gripping grooves 104 in the flange for permitting axial adjustment of the bushing 102 which is threaded into an associated threaded opening in the transverse slide bar. A collar 106 is rigidly secured to the flanged bushing 102 by a set screw 108 (FIGS. 4 and 6), and a resilient O-ring 109 is inserted in a groove in the collar 106 which acts as a cushioned soft stop for quiet, shockless operation.

A threaded locknut 107 includes a locking bar **107*a* and is manually loosened to permit manual rotation of the flanged bushing or manually tightened by using the bar 107*a*. After the fine tuning is completed the locknut is tightened to lock the associated pistons 38 (FIG. 4) in precise position to dispense a precise amount of flowable product into the container C. It will be apparent that moving the flanged bushing 102 to the left (FIG. 1) will reduce the volume of flowable material in the associated product cylinder 36**, and movement of the flanged bushing to the right will slightly increase the volume flowable material.

A switch actuating plate 110 (FIGS. 3, 4 and 5) is secured to the stub shaft 60 and has an opening 112 therein which slidably receives an elongated pin 114 (FIGS. 3 and 6) secured to the slide bar 80 thus preventing rotation of the plate 110. A switch 116 includes a spring return switch actuating arm 118 having a roller 120 on the outer end thereof which engages a finger 122 (FIGS. 5 and 6) for reversing the direction of movement of the associated piston 38. As illustrated in FIG. 3, all switches 116 are in position to actuate a conventional circuit which causes the air cylinders 44 to move to the right as shown in solid lines in FIG. 4 thereby drawing a measured amount of flowable product into each cylinder 36. When the switch actuating plate 110 is in the position illustrated in solid lines in FIG. 4, the switch 116 is in position to cause the air cylinder 54 to move the measured amount of flowable product out of the product cylinder 36, through parallel linear passages 42 (only one being shown in FIG. 3) into the containers C (FIGS. 1 and 2).

When it is desired to adjust the positions of the pistons 38 in their cylinders 36, for first receiving an approximation of the desired amount of flowable product within each product cylinder, the operator must first release the set collars 98 (FIG. 3) by unscrewing both levers 100 thereby releasing the set collars 98. The operator then uses the hand crank 96 to move the transverse slide bars to a position where all pistons are positioned to receive approximately the desired volume of flowable material to be deposited into the containers C. The operator then makes several test runs to determine if the volume of product is greater or less than desired. The operator then grips the flanged bushing 102 and turns it in the appropriate direction until the precise volume of the flowable fluid is received in the associated cylinder. Thereafter the operator locks the associated flanged bushing 102 in place by gripping the locknut bar **107*a*** thereby accumulating the desired amount of flowable product to be transferred into the container C. The same procedure is, of course, repeated for each piston thus assuring that an oversupply or undersupply of flowable product is not dispensed into the containers.

From the foregoing description it is apparent that the volumetric adjustment device of the present invention may be adjusted to provide precisely measured amounts of flowable product into containers or the like, and to provide easy and fast cleaning of the cylinders 36, pistons 38, valve housing 24 and valve cores.

Although the best mode contemplated for carrying out the present invention has been herein shown and described, it will be apparent that modification and variation may be made without departing from what is regarded to be the subject matter of the invention.

What is claimed is:

1. An apparatus for filling a plurality of containers each with a precisely measured volume of flowable product from an associated one of a plurality of cylinders each having a piston and piston rod therein, comprising:

means for directing said flowable product into said plurality of cylinders;

reciprocable power means operatively connected to each of said piston rods;

first adjustment means operatively connected to said piston rods for roughly adjusting the position of said pistons in said associated ones of said cylinders for receiving a rough approximation of the desired volume of flowable product in each of said cylinders;

a plurality of fine tuning means operatively connected to said first adjustment means for precisely adjusting the position of said associated pistons in corrected extended positions within each of said associated cylinders for providing equal volumes of flowable product to be discharged into each of said containers;

said plurality of fine tuning means being independently adjusted to provide precisely the same measured volume for each of said cylinders;

said first adjustment means including;

a transverse slide bar mounted for movement toward and away from said plurality of cylinders;

means for moving said transverse slide bar into a selected rough adjusting position; and means for locking said transverse slide bar into said selected rough adjustment position.

2. An apparatus for filling a plurality of containers each with a precisely measured volume of flowable product from an associated one of a plurality of cylinders each having a piston and piston rod therein, comprising:

means for directing said flowable product into said plurality of cylinders;

means defining a transverse slide bar mounted for movement toward and away from said plurality of cylinders;

reciprocable power means operatively connected to each of said piston rods;

first adjustment means operatively connected to said piston rods for roughly adjusting the position of said piston in said associated ones of said cylinders for receiving a rough approximation of said desired volume of flowable product in said associated ones of said;

a plurality of fine tuning means operatively connected to said first adjustment means for precisely adjusting the position of said associated pistons in corrected extended positions within each of said associated cylinders for providing equal volumes of flowable product to be discharge into a container;

said plurality of fine tuning means being independently adjusted to provide precisely the same measured volume for said plurality of cylinders; and means for supporting said fine tuning means on said transverse slide bar.

* * * * *